United States Patent [19]

Yarnick

[11] 4,145,861

[45] Mar. 27, 1979

[54] BUILDING CONSTRUCTION METHOD AND SYSTEM

[76] Inventor: Ralph Yarnick, 339 Country Club Dr., Tequesta, Fla. 33458

[21] Appl. No.: 760,797

[22] Filed: Jan. 19, 1977

Related U.S. Application Data

[60] Division of Ser. No. 539,087, Jan. 7, 1975, abandoned, which is a continuation-in-part of Ser. No. 434,555, Jan. 18, 1974, abandoned.

[51] Int. Cl.[2] ..... E02D 27/00

[52] U.S. Cl. ..... 52/742; 52/294

[58] Field of Search ..... 52/293, 294, 742, 741, 52/745, 236.7, 236.8, 236.9, 169.9, 292, 296

[56] References Cited

U.S. PATENT DOCUMENTS

| | | | |
|---|---|---|---|
| 2,815,656 | 12/1957 | Klein | 52/169.9 |
| 2,882,712 | 4/1959 | Carlson | 52/293 |
| 3,490,186 | 1/1970 | Hammond | 52/169.9 |
| 3,566,560 | 3/1971 | Wakefield | 52/236.7 |
| 3,706,168 | 12/1972 | Pilish | 52/294 |
| 4,018,021 | 4/1977 | Dow | 52/262 |

*Primary Examiner*—John E. Murtagh

*Attorney, Agent, or Firm*—Leitner, Palan, Martin & Bernstein

[57] ABSTRACT

A building constructed from free standing precast stress bearing will modules by placing the elements in a trench, pouring a flowable material therein, and allowing the flowable material to set. Metallic elements extending from the wall into a recess in the bottom of the wall interconnect with the flowable material in the trench to form an integral unit of the set flowable material and the wall module. For subsequent stories, the free standing precast stress bearing wall modules include a pocket in their lateral wall to provide access to the interconnection for the fastening of a plate embedded adjacent the bottom thereof and a rib extending from the top of a lower building element.

11 Claims, 15 Drawing Figures

BUILDING CONSTRUCTION METHOD AND SYSTEM

RELATED APPLICATIONS

This is a divisional of application Ser. No. 539,087, filed Jan. 7, 1975, now abandoned, which in turn is a continuation-in-part of application Ser. No. 434,555, filed Jan. 18, 1974, now abandoned.

BACKGROUND OF THE INVENTION

1. Field of the Invention

The present invention relates generally to prefabricated houses and more specifically to a method of using precast structural elements to form the walls and corners of a prefabricated house.

2. Description of the Prior Art

In the field of housing construction, there has been a long-felt need for production of a well-built, inexpensive unit. With the increased cost of lumber and skilled labor, the cost of housing is increasing at an astronomical rate. Many solutions have been proposed to reduce housing cost. For example, wall sections are pre-assembled in a production line technique and are shipped to sites where they are interconnected. The materials used have included wood as well as concrete. The wood is more expensive as a raw material then concrete, but it is also easier and cheaper to transport. Conversely, concrete is a cheap material but is is very expensive to transport in large sections since its high density increases the weight of the load.

The cost of building a factory and the problems and expense of transportation have almost brought to a halt the construction of concrete cubicals which are stacked in various configurations on site to complete a house. Realizing that the concrete is an inexpensive material, other types of prefabricated concrete elements have been used to structure houses. These articles have included enormous L-shaped slabs constituting a wall and a floor or a wall and a ceiling of a unit, prefabricated T's and H's which also constitute walls and ceilings or floors and various other configurations.

Though using prefabricated concrete sections to be assembled in formed dwellings, the sections in general have been very large and thus have not overcome the transportation problem. Similarly, these various segments and configurations which have been used in the prior art have not been versatile enough to reduce the number of parts or the skill of the labor involved in assembling these elements to create a dwelling. Also, the lack of versatility of the prefabricated concrete configurations of the prior art have limited the architect's scope in designing the houses or dwellings.

Though concrete dwellings were considered the answer to tornadoes and earthquakes, as of yet no specific prefabricated concrete house has been considered sufficiently earthquake-proof. With the recent earthquakes in Nicaragua and various other Central American countries, a great need exists for a building construction which will withstand great quake tremors for a sufficient amount of time to allow the inhibitants to escape the dwellings. To withstand large tremors, a structure must be capable of distributing large horizontal and vertical forces and motions. Normally, either direction of motion will cause interconnecting structures to sheer and thus separate.

SUMMARY OF THE INVENTION

The present invention is a building construction method and system to provide a building which is more earthquake-proof than those previously available. The system and method is based upon positioning precast free standing wall modules in shallow excavated trenches. The trenches from the general outline of the building structure, including the outer perimeter and all interior walls. By making the width of the trenches larger than the width of the wall modules, a greater degree of freedom of alignment of the wall modules is provided. After the wall modules have been placed in the trenches, a flowable material (such as concrete) is poured into the trenches and allowed to set. This provides an integral wall module and footing without the use of mechanical fasteners. The integral module prevents sheering of the footing and the wall during earthquakes and allows transmission of motion or stress produced by the earthquake through the integral module and footing. Before or after the pouring of the footing, the roof structure or ceiling is interconnected to the top of the plurality of precast modules forming the outer perimeter of the building. If necessary, the points at which the wall modules make contact with the base of the trench may be levelled before the pouring of the flowable material into the trench.

The free standing precast modules which are placed in the trenches are of a unique design, having a recess in the bottom edge of the wall module into which extends metallic elements which are embedded in the precast module. When the footing is poured, the metallic elements increase the strength of the unitary footing and wall module by its interconnection. The recess provides a nonplanar interconnecting surface between the footing and the wall module and thus eliminates a sheer prone interconnection. The ceiling or roof is generally a slab structure with a plurality of apertures to receive metallic elements extending from the top of some of the wall modules. In a one-story building, the metallic elements are secured to the ceiling by pouring a second layer of concrete on a concrete slab roof structure. The second layer of concrete may be of a density less than the density of the slab structure, since it is used for interconnection and insulation purposes and not as a structural layer.

If the structure is to have a multitude of stories, a different type of wall module is placed on the ceiling or roof structure of subsequent levels. This wall module has apertures in the bottom thereof to receive the metallic elements extending up through the floor from the lower level wall modules. A metallic plate is embedded near the bottom of the second story wall module to which the lower level's metallic elements are connected by bolts. A pocket is provided in the lateral wall of the wall module to provide access to this interconnection. Ribs which traverse the total height of the second story wall module are connected to the plate and allow transmission of forces through the wall module. These ribs extend out of the top edge of the second story wall module to allow interconnection to its ceiling structure and to any subsequent upper stories and wall modules.

The precast free standing wall modules can be classified as stress bearing and non-stress bearing. The stress bearing wall modules may be formed from a concrete having a higher density than the non-stress bearing wall modules. The non-stress bearing wall modules may be added after the footing is laid or they may be placed in the trench and become an integral part of the single, integral, unitary wall-footing structure. A unique gang type of mold is provided so that the wall modules may be manufactured in situ and thus reduce the cost of transportation. The wall modules and their molds may be generally inclusive of two walls which may either meet at a right angle or the walls may be curved portions. Recesses are provided in the top of the wall modules, centered on the ribs, allowing the connection of spans between various wall modules where desired.

OBJECTS OF THE INVENTION

An object of the present invention is to provide a more earthquake-proof dwelling.

Another object of the invention is to provide a structural element for use in constructing prefabricated houses which reduces the number of parts.

A further object of the invention is the provision of a prefabricated concrete element whose density may be varied in accordance with structural requirements.

Still another object of the invention is to provide an integrally formed structural element whose versatility will allow a variety of designs to be made with a minimum number of parts.

A still further object of the invention is to provide an integrally formed concrete element to be used in the walls of a house which is free standing and which requires no additional structural support.

An even further object of the invention is to provide a structural element to be used in the construction of prefabricated houses which may be mass-produced on the site and thereby reduces production and transportation costs.

An even further object of the invention is to provide an inexpensive, mold wall which may be used to produce a plurality of prefabricated structural concrete elements.

A further object is to provide a unitary wall-footing structure which has no horizontal plane which is susceptible to sheer forces.

Still another object is to provide a method of building construction which is inexpensive without sacrificing structural stability and integrity.

A still further object is to provide a method of building construction which drastically reduces the time of assembly and minimizes the need for skilled laborers.

Other objects, advantages and novel features of the present invention will become apparent from the following detailed description of the invention when considered in conjunction with the accompanying drawings.

DESCRIPTION OF THE PREFERRED EMBODIMENTS

The method of the present invention involves excavating a trench which defines the general layout of the building structure. These trenches define the exterior periphery of the building and the interior location of the walls. In these trenches are placed free standing precast wall modules. Flowable material is poured into the trench and allowed to set so as to form a unitary footing-wall module combination. The ceiling or roof structure is interconnected to the top of the free standing precast wall modules. This is the general building structure to which a plurality of additional floors may be added.

The basic building block of this method is the free standing precast wall modules. These modules may have various designs and configurations as illustrated, for example, in the preferred embodiments of FIGS. 1–4. By using a simple basic design, a single type of wall module may be used to build an entire house or building structure without limiting the versatility of design. Similarly, the free standing precast wall module is a structurally sound element which provides transmission of forces through itself and, when used in combination with its unitary footing, provides a more earthquake-proof structure.

Figure 1:
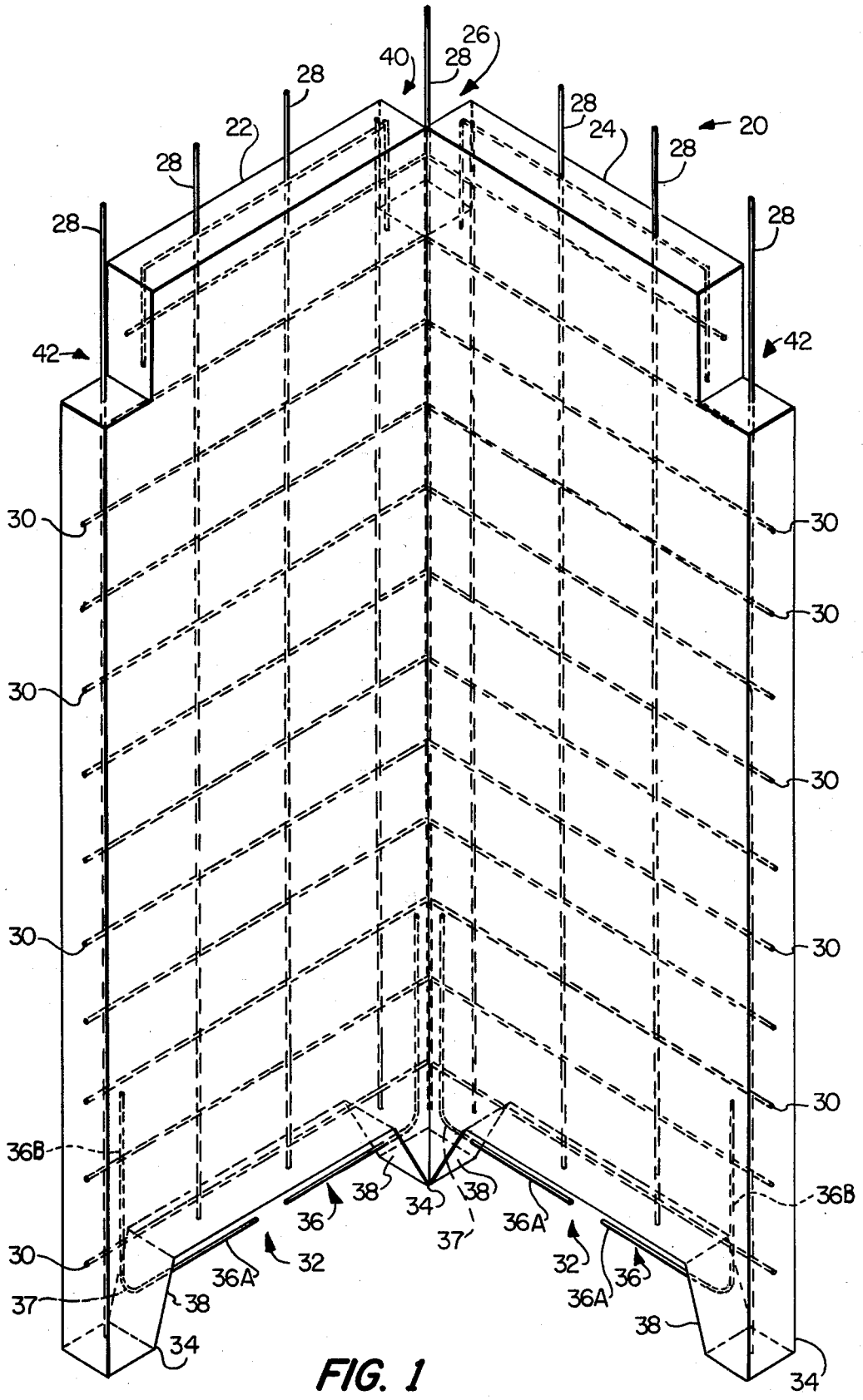
FIG. 1 is a perspective view of the preferred embodiment of the free standing wall modules of the present invention.

As illustrated in FIG. 1, a preferred embodiment of the wall module shows an integrally formed two-vertical wall module 20. The vertical walls 22 and 24 of module 20 meet at right angles to form a corner 26. Embedded within the walls 22 and 24 are a plurality of reinforcing ribs 28 running substantially the height of the walls and extending substantially from the top thereof. Additional internal support is provided by horizontal ribs 30 running substantially the width of walls 22 and 24.

Figure 13:
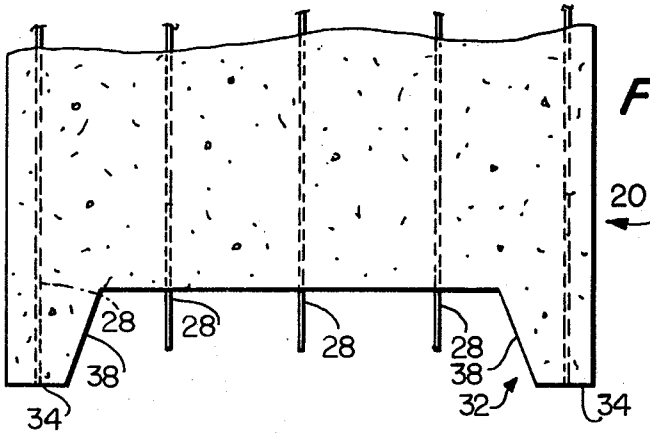
FIG. 13 is an alternate embodiment of the wall module of the present invention.

In the bottom surface of each wall 22,24 is a recess 32. The recess 32 extends over a substantial portion of the width of the walls 22,24 and defines feet 34. Extending across each recess 32 approximately parallel to the bottom edge of the wall are two metallic elements or reinforcing rods 36. Each reinforcing rod is made up of two legs wherein one leg 36A is substantially horizontal and extends across the recess, while the other leg 36B is substantially vertical and is embedded totally within the interior of the wall. By providing the point 37 at which the two legs of the rod 36 meet interior to the wall, the portion of 36A which extends in the recess is substantially fixed relative to the wall module. An alternate method of interconnecting the wall module and the footing is to extend the ribs 28 into the recess 32, as illustrated in FIG. 13.

As will be explained more fully later, the specific shape of the recess 32 having inclined walls 38 and the extended metallic elements 28 or 36 provide an interconnecting system to the footing which is more earthquake-proof. This improved system provides a non-planar interconnection to the footing and thus prevents the formation of a horizontal plane which is susceptible to sheer forces as experienced by the interconnection of prior art devices. Though the element 36 is shown as being two parts, each extending into the recess, it is obvious that the element 36 may be one continuous metallic element having one horizontal and two vertical legs.

Figure 2:
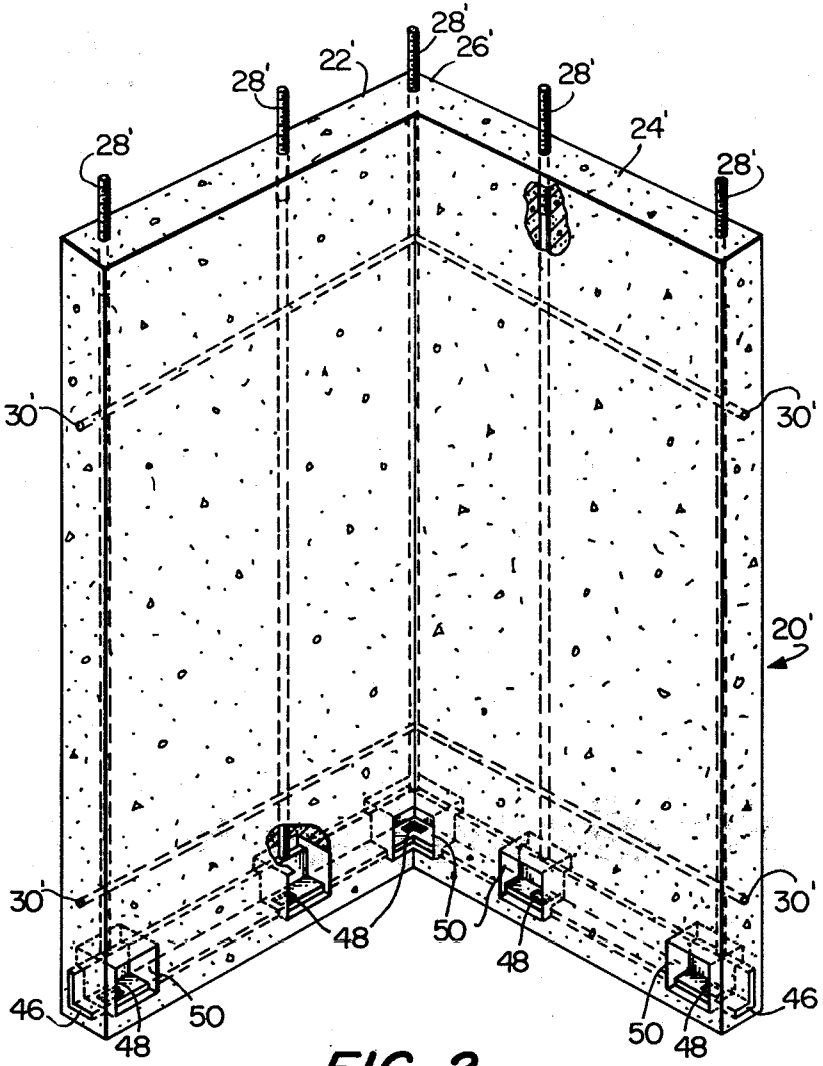
FIG. 2 is a perspective view of another embodiment of the wall modules of the present invention.

The upper ends of ribs 28 extend above the top of the walls and may be threaded (as shown in FIG. 2) or they may be continuations of the ribs. The standard ribs 28 may be threaded on site or the thread ends may be a separate element secured to the horizontal ribs 30 by welding or by wires as is well known in forming cages in concrete element formation. Similarly, for added strength of the connection, the threaded ends of 28 may be the ends of an anchor bolt wherein the anchor is secured around the horizontal ribs 30.

Another technique for providing the extensions of ribs 28 is to form the ribs 28 having an insert or adapter secured to the end thereof embodied within the walls. A threaded element may later be attached to the adapter or insert so as to extend above the top edge of walls 22 and 24. By using the insert or adapter type of device, the ribs 28 may be used to provide structural stability for the wall and fewer fasteners may extend above the top of the wall. This will reduce the amaount of labor needed to remove the extension of ribs 28 if they are not desired to be secured to the ceiling of the building structure.

The ribs 28 extend sufficiently above the top edge of the walls 22 and 24 so as to transverse the floor or the ceiling or the roof of the structure so that they may be fastened thereto. Similarly, if the building is to be multistoried, the ribs 28 are sufficient so as to extend through its ceiling and the floor of the unit above and toextend into the bottom of the walls 22 and 24 of the second story and be secured thereto as described more fully below.

Figure 3:
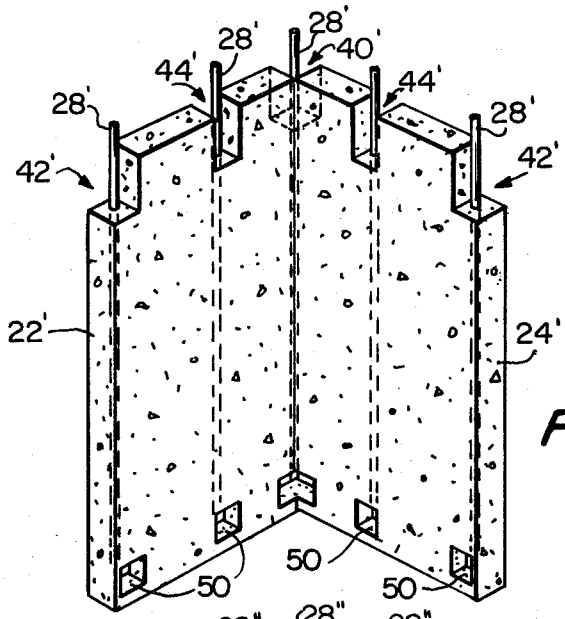
FIG. 3 is a perspective view of even another embodiment of the wall modules of the present invention.

The upper edge of walls 22 and 24 may be modified so as to allow interconnection of span elements to provide sufficient support for the roof or ceiling. Though the structural modules 20 are designed to stand alone as a unitary element with the footing or as secured to the ceiling, the span elements do add, when used, additional support and rigidity in the lateral direction. As illustrated in FIGS. 1 and 3, a variety of recesses may be provided in the upper edges of the walls 22 and 24 to accommodate the span elements. The recesses 40, 42 and 44 are centered upon their respective ribs 28. Though all the recesses are shown as being embodied in a single wall module in FIG. 3, any or all of the recesses 40, 42 and 44 may be formed in a given wall module.

The wall module 20 of FIG. 1 is designed for use on the ground level in a trench. As previously explained, when concrete or other flowable material is poured into the trench and allowed to set, the footing formed is a unitary structure with the wall module. For subsequent levels in a building or for use in a non-earthquake prone area, the wall module 20′ of FIGS. 2 and 3 may be used. As with the wall module of FIG. 1, two vertical walls 22′ and 24′ of module 20′ meet at a right angle to form a corner 26′. Embodied within the walls 22′ and 24′ are a plurality of reinforcing ribs 28′ running substantially the height of the walls and extending substantially therefrom. Additional internal support is provided by the horizontal ribs 30′ running substantially the width of the walls 22′ and 24′. Adjacent and generally parallel to the bottom of walls 22′ and 24′ is embodied a plate 46 having apertures 48 therein. Plate 46 is shown as being L-shaped, but it may be any convenient shape (for example, a horizontal plate). As illustrated in FIG. 2, the ribs 28′ are secured to the plate 46 and are vertically aligned with apertures 48 in the plate 46. In the face of walls 22′ and 24 are a plurality of pockets 40 allowing access to the apertures 48 in plate 46. In the bottom edge of the walls 22′ and 24′ are corresponding numbers of apertures which are aligned with apertures 48.

Figure 14:
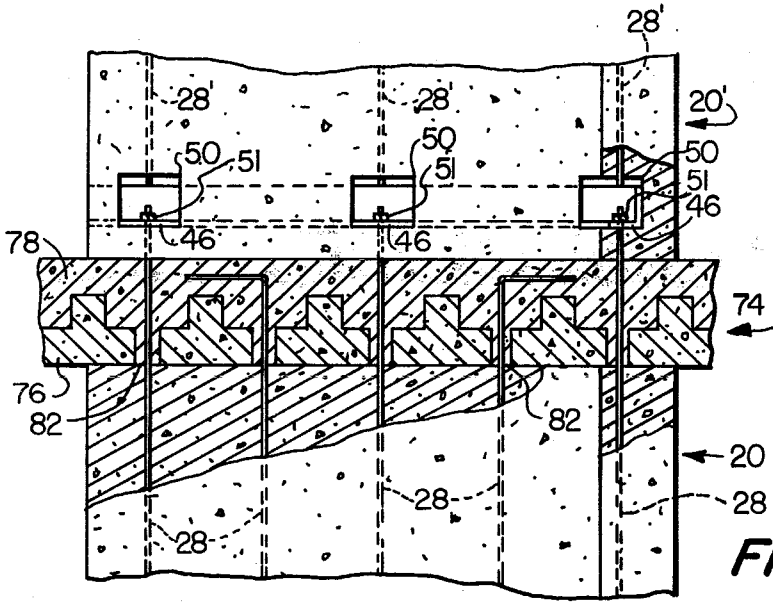
FIG. 14 is an enlarged cross-sectional view of the interconnection between stories of a multi-story structure.

In general use, the walls 22′ and 24′ are placed over fasteners which extend up from a floor and protrude through the bottom of the walls through apertures 48. Locking means 51 would be inserted through pockets 50 and connected to the ends of the fasteners so as to secure the walls to the floor. A typical example would be using anchor bolts in a ground level floor as a fastener and nuts as the locking means, though other types of fasteners and locking means may be used. If the wall module of FIG. 2 is used only on levels above ground level, the fasteners are the threaded extensions of ribs 28 from the wall module of the lower level as illustrated in FIG. 14.

the upper end of ribs 28 extends through the ceiling of the building structre and are secured to the ceiling by known locking means. If the end of ribs 28 are threaded, the locking means may include nuts. If the ceiling includes a first structural layer and a second layer which is concrete to be poured upon the structural layer, the locking means would include the second poured concrete layer.

The interconnection of the ribs 28 from the lower level to the plate 48 of the upper level provides a building structure where the load of the building may be transmitted from the top to the bottom thereof through a continuous metal framework including ribs 28 and connecting plates 46.

Though the preferred embodiment illustrated in FIG. 2 has five ribs 28′, as few as three or four ribs may be used, if desired. For example, the ribs at the two ends of the wall and at the corner of the wall are sufficient to provide structural stability for the concrete walls and to provide sufficient means to secure the walls to the ceiling. The same is applicable to the metal cage of the wall module of FIG. 1.

Figure 4:
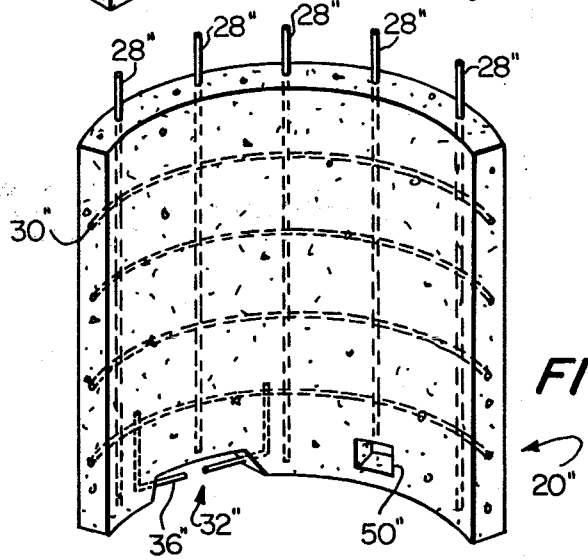
FIG. 4 is a perspective view of still another embodiment of the wall modules of the present invention.

FIG. 4 shows a curved wall module 20″ configuration of the present invention. The vertical and horizontal reinforcing rods 28″, 30″ are included therein. Just by way of illustration, the curved wall module 20″ of FIG. 4 has a recess 32″ therein with metal elements 36″ extending thereacross as well as a pocket 50″. This is not to infer that in curved wall module 20″ both would be utilized, but that the curved wall module may include either of the lower connection embodiments shown in FIGS. 1 and 2. If the curved wall module 20″ of FIG. 4 is to be used in a trench system, it would include the recess 32″. If it is to be used in a non-trench system or on levels other than the ground level, it will include the pockets 50'' and the corresponding base plates 46'' (not shown). FIG. 4 is presented to illustrated that the shape of the specific wall segment is not critical, the only importance being that it be free-standing and precast as well as providing some interlocking structure that is unique (as shown in FIG. 1) or in the alternative the unique structure of FIG. 2.

Figure 5:
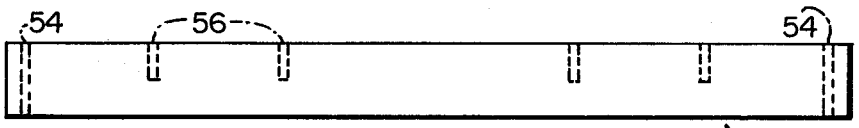
FIG. 5 is a front view of a span of the present invention.

As previously mentioned, the recesses 40, 42 and 44 are provided for use with span elements. A typical span element 52 is illustrated in FIG. 5 as having orifices 54 passing therethrough and orifice 56 passing partially therethrough. The ends of span 52 generally are secured in the recesses 40, 42 and 44 with the ribs 28 extending through orifices 54. Orifices 56 are provided with insertion of fasteners so as to secure the center of the span to the ceiling. Though being illustrated with orifices 54 at the end thereof, the span 52 may have orifice 54 at various other places within the span. Span 52 is generally the same width as walls 22 and 24 and has a height equal to the depth of recesses 40, 42 and 44.

Figure 6:
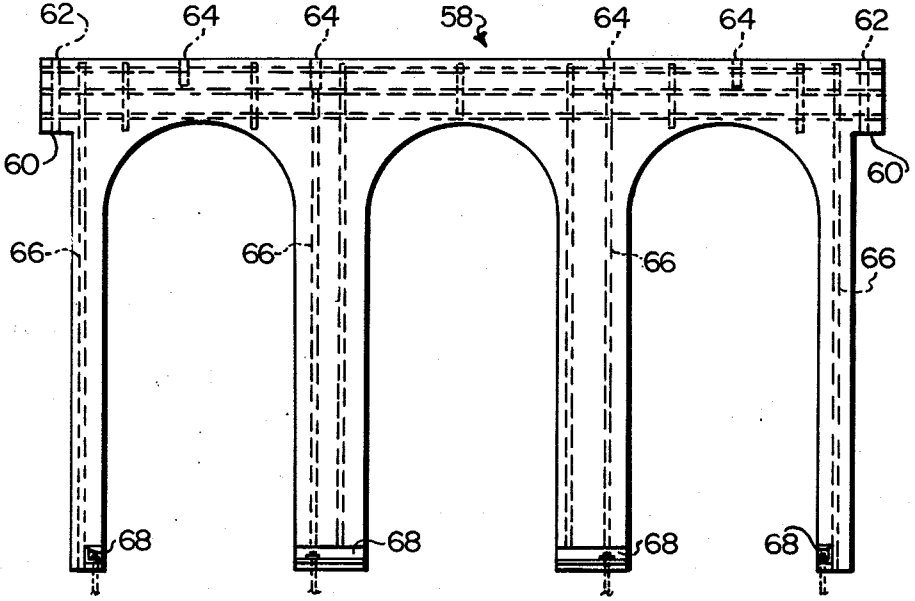
FIG. 6 is a front view of a span in combination with archways of the present invention.

A variation in span 52, as shown in FIG. 6, is a span 58 having three archways therein. The span 58 has two shoulders 60 at the ends thereof that are to be received in recesses 40, 42 and 44 of walls 22 and 24. Orifices 62 are provided in the shoulders 60 to receive the extensions of ribs 28. As in the span 52, arched span 58 includes shallow orifices 64 to receive fasteners so as to be secured to the ceiling. Each leg of the arch has a rib 66 therein attached to a plate 68 in the bottom thereof. The ribs 66 and the plate 68 serve the same purpose as ribs 28 and plates 46 in the walls 22' and 24'. In the alternative, the legs of the arch may be placed in the trench and become a unitary part of the footing.

Figure 7:
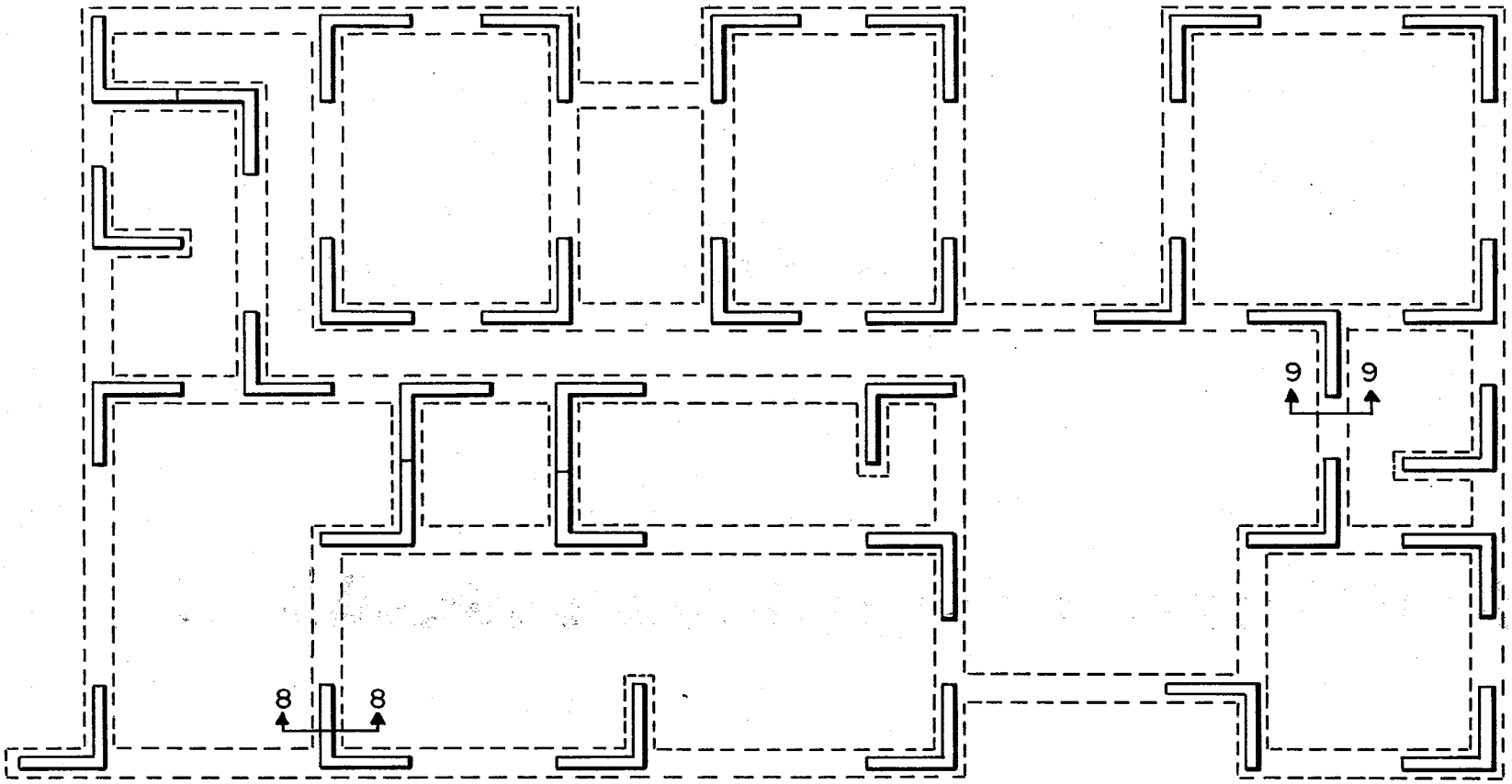
FIG. 7 is a top view of the excavated trench defining the building structure layout with the free standing wall modules and footing therein.

A general trenching scheme, as illustrated in FIG. 7, includes external continuous trench which defines the layout of the house. The external perimeter of the house is defined by the trenches as well as the interior location of the walls. As shown, a plurality of right angle wall modules are shown in position in the trenches. The trenches have a width greater than the width of the modules, so that the trenches to be excavated without any great degree of accuracy. The width of the trench which may be, for example, twice the width of the wall module, provides sufficient area for aligning the placement of the wall modules in the trench.

Before placing the wall modules, the points at which the legs 34 of the wall module 20 touch the base of the trench may be levelled. This levelling may be produced by pouring a small amount of concrete and levelling the same at these points or by the placement of cinder blocks or the placement of other levelling elements or materials.

Figure 8:
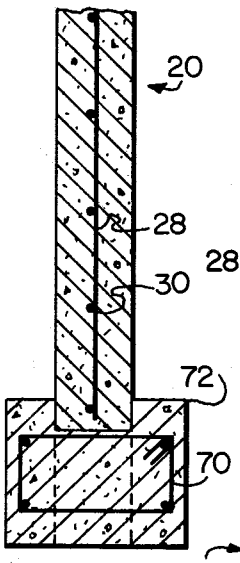
FIG. 8 is a sectional view along lines 8—8 of FIG. 7.

To increase the structural stability of the foot and its unitary interconnection with the wall modules, a wiring cage (as shown in FIG. 8 as 70) may be pre-placed in the trenches. Thus, when the flowable material is poured into the trenches and cures, a unitary and structurally sound footing and wall module combination is achieved. The footing 72, as illusrated in FIG. 9, exceeds the height of the recess opening 2 and thus encloses the surfaces of interconnection within the wall modules. The footing 72 may be poured so as to be flush with the earth surface.

Similarly, the interconnection of the extended ends of rod 28 with the ceiling structure for a single story building is shown. It should be noted that the interior wall modules need not be fastened or secured to the ceiling or roof structure, since they are basically a free standing unitary structure within the footing, The lack of interconnection to the ceiling permits shifting of the ceiling structure relative to the wall modules during an earth tremor and thus eliminates any stress produced by such movement on the wall modules.

The roof of the present invention may be of any standard type elements. It is shown at 74, though it may be of corrugated metal or a wood frame-single construction, as being a slab of concrete. Slab 74 has a structural layer 76 and a nonstructural insulation layer 78. Lower layer 76 may be corrugated metal or structural density concrete which may be 50–144 lbs/cubic foot, but is generally 80–144 lbs/cubic foot. Insulating layer of concrete 78 has a density of less than 50 lbs/cubic foot and is generally in the range of from 25–35 lbs/cubic foot. As mentioned previously, layer 76 may be placed upon the tops of the walls of the structure and layer 78 poured thereon, thus acting not only as insulation but to act as a locking means for the fasteners which are an extension of rib 28.

Figure 9:
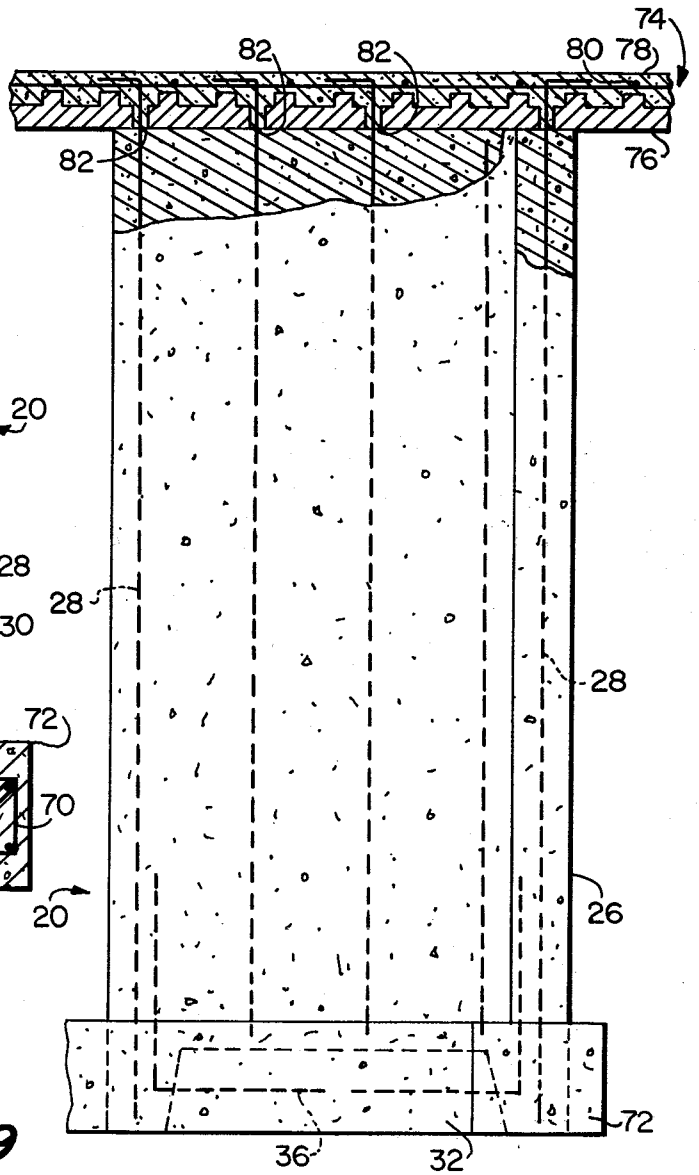
FIG. 9 is a sectional view taken along lines 9—9 of FIG. 7.

A wire grid 80 is provided for the poured layer 78, by may be eliminated if desired. The roof or floor slab 74 may be pre-plugged or plugged on the site to provide apertures 82 to receive the ends of ribs 28. The poured layer 78 fills the apertures 82 and providdes a secure structure. The slab 74 in FIG. 9 is the roof for a single story building. The ends of the ribs 28 are shown bent but may alternatively be left straight and, subsequent to the pouring of layer 78, cut off.

If a second story is to be built, the ribs 28 will preferably include a threaded portion extending above the top surface of layer 78 to be connected to the plates 46 of the second story wall modules. As illustrated in FIG. 14, the first story wall module 20 is that of FIG. 1 being placed in a trench system. The ends of ribs 28 extend through ceiling/floor structure 74 for interconnection with plate 46 of second story wall module 20' of FIG. 2 by fastener 51. As illustrated in FIG. 14, not all of the ends of the ribs 28 of the lower wall module 20 may be needed for structural stability and thus are bent so as to be secured to the ceiling structure 74. All subsequent stores would use wall module 20' as the basic building block.

Figure 10:
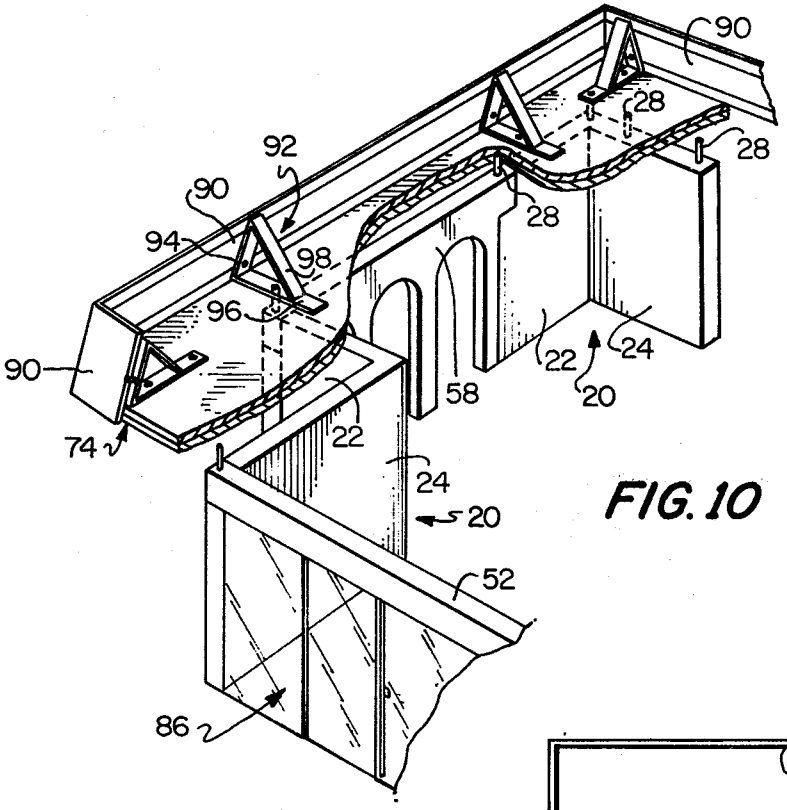
FIG. 10 is a perspective cut-away view of a dwelling constructed according to the present invention.
Figure 12:
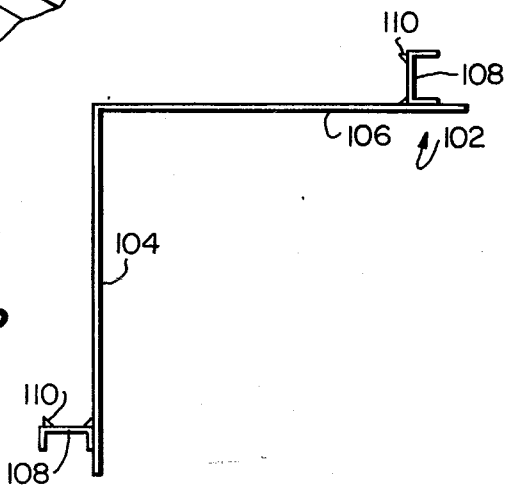
FIG. 12 is a top view of a single element of the mold of the FIG. 11.

A cutaway partial view of a one-story structure built according to the present invention is shown in FIG. 10. A first wall module 20 is shown having a span 52 attached to wall 24 thereof. Secured to and sliding within span 52 are glass doors 86. Secured to wall 22 of the first module 20 and to a wall 22 of second module 20 is an arched span 58. A roof or ceiling 74 is shown in FIG. 10 as extending over the edges of the exterior walls. By extending the roof 74 over the exterior walls in a cantilevered fashion, the roof will not collapse or fall within the interior of the house during severe earthquakes. This will allow the occupants of the house to flee to safety and not be crushed by the falling roof.

Around the periphery of roof 74 is also shown a facia 90. This facia secured to the roof by a plurality of brackets 92. This bracket 92 has a leg 94 to which the facia 90 is secured and a second leg 96 which is secured to the ceiling 74. A third leg 98 spans between legs 94 and 96 to add additional support. The apertures in base 96 may be so located as to correspond to the location of the threaded extension of ribs 28 so that no additional fasteners are needed to secure the brackets 92 to the ceiling or roof if they align with the wall. If a wall is not below the bracket 92, leg 96 may be secured directly to the roof by suitable fastening means.

Figure 15:
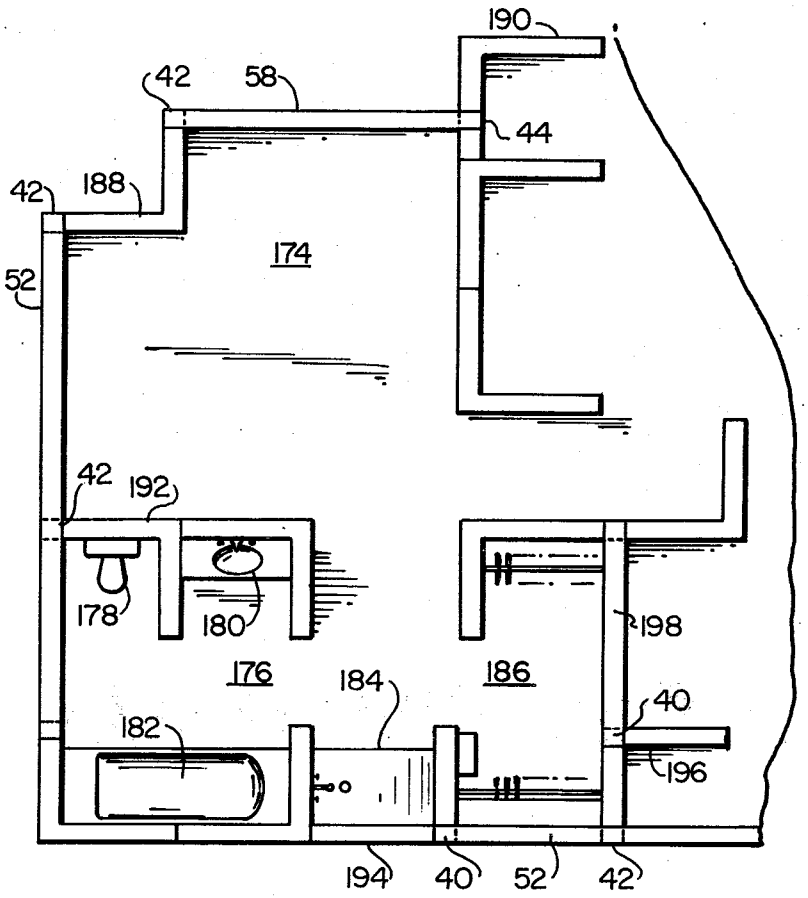
FIG. 15 is a portion of a detailed floor plan of a building constructed according to the present invention.

A portion of a detailed floor plan is shown in FIG. 15 and includes a bedroom 174 having a combined bathroom and dressing area 176. Commode 178, a washbasin 180, a bathtub 182 and a shower stall 184 are provided therein. A large walk-in closet 186 is also part of the design of the bath and dressing area 176. The floor plan was produced to show the various combinations to which the basic module 20 may be used. For example, a corner structural element or module 188 is shown having recesses 42 therein to support an arched span 58 and a straight span 52 therefrom. The other end of the span 58 is shown as being received in recess 44 of module 190. The span 52 lies in recess 42 of module 192 and continues thereacross. The module 194, which is the back of shower stall 184, is shown as having only a recess 40 in the corner thereof. Another module 196 is shown as having a corner recess 40 and an end recess 42.

Thus, the basic two-wall module can be used as a basic building element in a building having a variety of recesses therein to accommodate many combination of spans. It should be noted that element 198, which is received in recess 40 of module 196, is an internal wall and is not necessarily one of the structural spans equivalent to 52 or 58.

As can be seen from the floor plan shown in FIG. 15, no connection between the individual modules is needed to assure structural stability for the vertical walls. This lack of interconnection not only reduces the number of parts needed, but also the time involved in constructing the building. Similarly, a plurality of basic modules 20 may form one or more complete walls of a room.

The walls between the wall modules 20, since they are non-load bearing, can be of any desired material and construction (such as windows, doors, brick, wood, etc.) or whatever the choice of design would require. Similarly, the molds for the construction of the wall modules 20 may be so designed as to provide the desired exterior texture to the concrete. Not all of the modules 20 illustrated in FIG. 7 are load bearing. By making the load bearing wall modules and non-load bearing wall modules of substantially identical cross-sectional configurations, a single module may be mass produced and used to provide a substantial portion of the walls of the building without limiting the variety of design.

Figure 11:
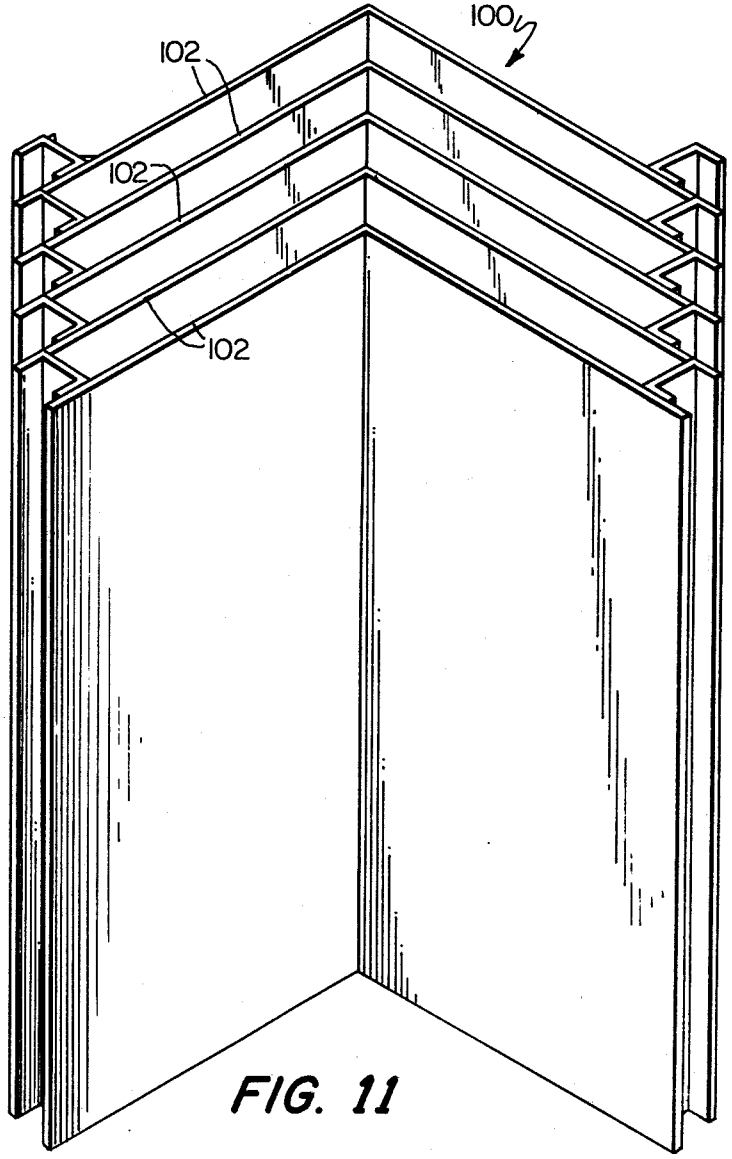
FIG. 11 is a perspective view of a mold according to the present invention, which is used to produce the preferred embodiments of FIG. 1.

A mold 100 for the production of a plurality of the modules 20 is illustrated in FIG. 11 as a five unit mold. The mold 100 is made up of a plurality of segments 102. For making five wall units, six identical segments 102 are used. Each segment has two members 104,106 at right angles to each other. Each member has a flange 108 secured thereto. Similarly, each flange 108 has a lip 110 at the edge thereof. Flanges 108 are located on the outside of the right angle and in from the edge of the sections 104 and 106 so as to form the end walls of the structural elements formed. As can be seen in FIG. 11, the lateral edges of members 104 and 106 of the preceding section 102 is adjacent to and communicates with flanges 108 and lip 110 of the preceding member. The mold sections 102 are all identical and symmetrical, as are the walls of the wall modules 20 formed therein. The symmetrical sections 102 with their flanges 108 and lips 110 are self-aligning and thus may be put together without skilled labor to provide a closed, accurate mold for casting concrete. As is well known in the industry, the cage formed by ribs 28 and 30, as illustrated in FIG. 1, is inserted between sections 102 and the concrete poured therein. To form recesses 32, 40, 42 and 44, spacers or other well known devices are inserted at the bottom and top of the mold to prevent the concrete from filling that desired recess. Since the mold is simply constructed, the wall modules 20 may be formed on site and thus one element of the cost of the construction of the house is removed, namely, that of transportation.

The suggested dimensions of the wall module 20 is a height of 8' and a thickness of 6", with an outside length of 4'. These dimensions allow for the use of the wall modules 20 with well known standard dimensions in the housing industry.

Also, to reduce the cost of the construction of the house, the wall module 20 may be made of different densities of concrete. The two modules 20 which are load bearing elements, should have a density of between 80 and 120 pounds per cubic foot. The non-load bearing enerally interior two-wall modules 20 may have a lighter density sufficient to provide sound insulation in the interior. This density is generally between 40 and 60 pounds per cubic foot. The varying density can be achieved using a cellular or foam concrete wherein the mixture and density may be varied. This foam concrete is the same that is used to form the second layer 78 of the ceiling 74 illustrated in FIG. 9.

As integrally formed free standing two-wall module has been described which provides an inexpensive structural element of varying densities used to provide an inexpensive easily assembled element which is more earthquake resistant than devices of the prior art, when used to construct a building according to the method of the present invention. Although the invention has been described and illustrated in detail, it is to be understood that the same is by way of illustration and example only and is not to be taken by way of limitation. The specific dimensions depend upon the desired use and structural requirements. The spirit and scope of the present invention are limited only by the terms of the appended claims. Also, it should be noted that, in the claims, the terms "rods" and "ribs" are equivalents.

What is claimed is:

1. A method of construction a building comprising the step of:

excavating a series of trenches to define the location of the exterior and interior walls of said building;

positioning in said trenches a plurality of precast integrally formed concrete modules of right angle configuration and of sufficient height to define load bearing walls of said building;

positioning in said trenches additional precast modules of planar configuration to define additional walls of said building;

connecting selected additional walls selected load bearing walls;

pouring flowable material into said trenches and about the module bases and allowing it to set; and interconnecting a ceiling structure and the top ends of selected precast modules.

2. The method of claim 1 including the step of placing a metal cage in said trenches before positioning said precast modules.

3. The method of claim 1 wherein selected precast modules include integrally formed metallic elements extending from their top, said ceiling structure being interconnected to said precast modules by receiving said metallic elements in aperture in said ceiling structure and fastening said metallic elements to said ceiling structure.

4. The method of claim 3 wherein said ceiling structure is a precast unit and said metallic elements are fastened to said precast unit by pouring a layer of flowable material onto said precast unit and allowing it to set.

5. The method of claim 1 wherein selected ones of said precast modules include integrally formed metallic elements extending therefrom adjacent their bottom and said modules are interconnected to said set flowable material by said metallic elements.

6. The method of claim 5 wherein said selected over of said precast modules have a recess in their bottom surface and said metallic elements extend into said recess, and said trench is excavated to a depth greater than that depth of said recess.

7. The method of claim 1 wherein selected ones of said precast modules include integrally formed metallic elements extending from their top and said ceiling structure being interconnected to said selected ones of said precast modules by receiving said metallic elements, and including the additional steps of positioning a second plurality of precast modules on top of ceiling structure and securing said second modules to said metallic elements.

8. The method of claim 1 wherein selected precast modules include a recess in the top edge thereof, and including the step of positioning a span in said recess between two precast modules before interconnecting a ceiling structure.

9. The method of claim 1 including leveling said trench in the area on which said load bearing wall modules are to be positioned.

10. The method of claim 1 wherein said load bearing wall modules include recesses in the top edge, and said selected additional walls include shoulder portions to mate with said recesses and connecting said load bearing wall modules to said selected additional walls at the mating point.

11. The method of claim 1 wherein the width of the trench excavated is substantially greater than the width of the wall modules.

* * * * *